United States Patent [19]

Ciani

[11] Patent Number: 4,911,563

[45] Date of Patent: Mar. 27, 1990

[54] ANCHORSEAL

[75] Inventor: Faust A. Ciani, Largo, Fla.

[73] Assignee: Anchor Continental, Inc., Columbia, S.C.

[21] Appl. No.: 238,973

[22] Filed: Aug. 25, 1988

Related U.S. Application Data

[63] Continuation of Ser. No. 79,731, Jul. 31, 1987, abandoned.

[51] Int. Cl.[4] ..... B65D 33/16

[52] U.S. Cl. ..... 383/89; 206/813

[58] Field of Search ..... 383/88, 89, 90, 91, 383/71; 206/631, 632, 813; 229/80

[56] References Cited

U.S. PATENT DOCUMENTS

| | | | |
|---|---|---|---|
| 1,128,192 | 2/1915 | Smith | 383/90 |
| 2,182,261 | 12/1939 | Maas | 229/80 |
| 2,222,341 | 11/1940 | Stuhlman | 206/632 |
| 2,727,676 | 12/1955 | Tilly | 206/631 |
| 2,896,839 | 7/1959 | Barnes et al. | 206/632 |
| 2,923,454 | 2/1960 | Pupke | 206/631 |
| 3,212,698 | 10/1965 | Balcom | 383/88 |
| 3,301,466 | 1/1967 | Perino et al. | 383/89 |
| 3,410,393 | 11/1968 | Lee | 206/632 |
| 3,702,171 | 11/1972 | Levine | 229/80 |
| 3,806,024 | 4/1974 | Marchesani | 383/90 |
| 4,008,851 | 2/1977 | Hirsch | 383/71 |
| 4,260,061 | 4/1981 | Jacobs | 206/632 |
| 4,299,223 | 11/1981 | Cronkrite | 604/390 |
| 4,402,453 | 9/1983 | Regenstein | 206/813 |

*Primary Examiner*—Stephen P. Garbe

*Attorney, Agent, or Firm*—John J. Byrne

[57] ABSTRACT

An attachment for a flexible package is disclosed to enable the user to fasten a re-closable package. A bifurcated adhesive member is secured to the body portion of the package at a distance from the opening thereof. The member has a jaw-like construction with hingeline about which one of the jaws may pivot. When the jaws are opened by the user, the re-closed, folded end of the package may be inserted therebetween, and the jaws subsequently closed to retain the package in re-closed condition. It is particularly useful for flexible packages of corn flakes, potato chips, cheese, etc., where portions of the contents are removed over a period of time, gradually decreasing the volume of the contents and forming a sequentially smaller package which should be re-sealed to preserve the freshness of the contents.

4 Claims, 1 Drawing Sheet

ANCHORSEAL

This application is a continuation of application Ser. No. 079,976 filed July 31, 1987, now abandoned.

BACKGROUND OF THE INVENTION

Many flexible packaging containers have been developed for food products which are consumed over an extended period of time. It is important that the package be tightly re-closed to keep the remaining contents fresh for several days or weeks after the first opening of the package. Furthermore, the cost of the package must be kept low.

In some instances, the package is provided within a stiffer protective carton. In other cases it is a heavier gauge plastic material sufficiently strong to protect the contents without an outer carton.

Typical of this type of package is the glassine or waxpaper or plastic film material which is used in marketing dry breakfast food cereals such as corn flakes or potato chips, or the like. Another typical food product is a small block of cheese sold in a clear plastic film.

In each of these products, the user opens the package, removes a portion of the contents, and then re-closes the package until used at a future time.

Although the products, when initially sold, are fresh and maintained so because of the effective nature of the package, once the package is opened the contents are subject to deterioration, spoilage or contamination.

Merely folding the flexible package is generally not sufficient because of the "memory" of the material and its tendency to open by itself when on storage shelves or in refrigerator.

Many consumers have resorted to using Scotch-Tape or a rubber band to hold the folded portion in place, but it is generally inconvenient because such devices are not always at hand.

In another consumer product, tape-tabs are used to fasten a disposable baby diaper around the infant. These tape-tabs are multi-part devices, which are applied to the movable end of the product, so that such movable end may be secured in place on another portion of the diaper. In one sense, the baby diaper can be considered a "package" to contain the baby. Prior practice had been the use of safety pins or other non- associated closing devices, but in the more recent past the tape-tabs have been developed with a "reclosable" or "re- fastenable" feature that permits the diaper to be opened, the baby to be examined, and the diaper to be closed several times.

In such a "package" the size of the contents (i.e., the baby) does not change from time to time as the "package" is opened or closed.

An early "tape-tab" closure for non-flexible packaging was disclosed in the Hamaguchi U.S. Pat. No. 3,616,114 which was granted in 1971. This closure was used to fasten the stiff ends of a cardboard carton in "butting" relationship, and was attached to the movable end of the container.

In 1971, Gellert U.S. Pat. No. 3,620,217 disclosed a similar fastening for disposable baby diapers, with a further improvement disclosed in his U.S. Pat. No. 3,646,937 issued in 1972.

The baby diaper market was rapidly expanding in the early 1970's, and Buell, in his U.S. Pat. No. 3,848,594, granted in 1974, showed how a "Y-form" configuration of this tape-tab would provide a further improvement in the closing of a baby diaper product.

The re-closing of flexible packages or bags was considered as early as 1967 and disclosed in Perino U.S. Pat. No. 3,301,466 and with subsequent improvement such as that shown in Jaeger U.S. Pat. No. 4,328,895.

One of the earliest package-sealing devices was shown in Newman U.S. Pat. No. 2,153,310 on Apr. 4, 1939; but, like all the others, the closure device was either secured to the movable end of the package or was intended to be fully removed therefrom during the re-sealing and re-closing process and re-applied similar to the application of a strip of Scotch-Tape.

During the later part of the 1970's and early part of the 1980's, the re-sealability in multiple-closures of many of these products became a critical commercial matter, and one of the improvements is disclosed in the Cronkrite U.S. Pat. No. 4,299,223 which issued on Nov. 10, 1981. The Cronkrite patent is owned by the assignee of this patent. It particularly discloses how a tape-tab with a portion thereof having multiple strips of adhesive can be designed to provide a closure member which is strong in shear but weak in peel strength. However, the Cronkrite patent does not disclose the operative jaw-construction of the present invention.

SUMMARY OF THE INVENTION

The closure of the present invention is an adhesive member which is secured to the body of a package. It has a plurality of jaws, one of which has an adhesive surface thereon. The re-folded operative end of the package can be inserted between the jaws. When the jaws are closed, the end of the package is held in place in closed position. The member is attached to the package near the non-open end thereof, so that as the package is progressively emptied and re-closed upon a lesser volume of contents, the "flap" of the package may still be inserted into the jaws of the member where it is held in place until the next opening of the package.

Therefore, an object of the present invention is to provide a re-usable adhesive closure for a flexible package.

Another object of the present invention is to provide an inexpensive attachment for a flexible package to hold the re-closed end of the package in place as the package decreases in size.

A still further object of the present invention is to provide a closer mechanism for a flexible food package which can be applied to the original package and which can be utilized by the purchaser of the food product.

Of course, it is to be understood that the closure of this invention can be used on flexible packages holding nonedible products which are used over a period of time, such as nails, bolts, etc.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
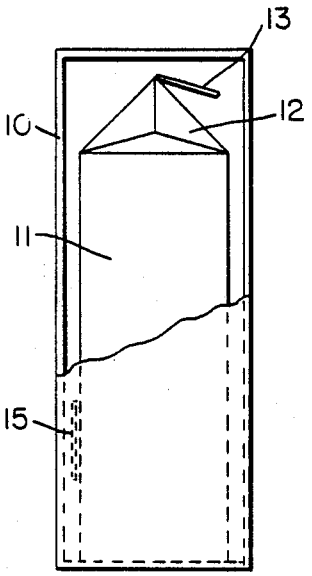
FIG. 1 is a side elevational view of the type of food package considered in the present invention.
Figure 2:
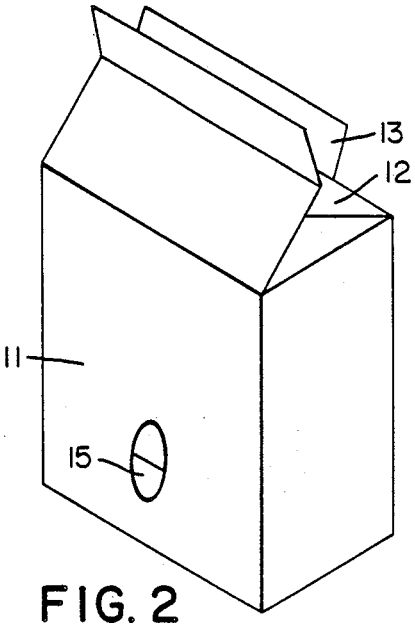
FIG. 2 is a perspective view of the collapsible inner portion of the food package of FIG. 1, with the closure of the present invention applied thereto.

Referring to FIG. 1 there is shown a food package which consists of a lightweight cardboard box (10) similar to that in which corn flakes are sold at the consumer market.

Within the box (10) there is a flexible, collapsible package made of wax paper, glassine, or thin plastic foil (11) into which the corn flakes or the like are packaged.

The operable portion (12) is folded into a gable-like arrangement with the uppermost portion (13) disposed so as to be easily opened by the consumer when the top of the cardboard box (10) is opened to expose the package (11).

In normal practice, after the package (11) is opened and some of the contents are removed, the upper portions (12) and (13) are folded back inside the box (10), the top of the box closed, and the package replaced on the shelf in the kitchen. However, because such reclosing is not airtight, and because the material from which the package (11) is made has "memory", there is a tendency for the package to open, and the contents are exposed and generally deteriorate.

Figure 3:
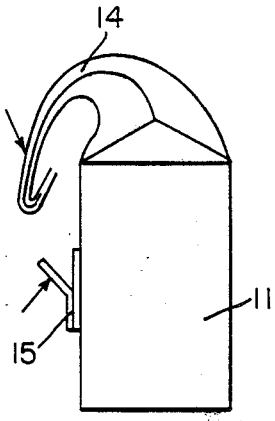
FIG. 3 is a side elevational view showing the inner portion of the package with some of the contents removed and with the operative end folded over and about to be secured by the closure of the present invention.

With the closure of the present invention applied to the package (11), the package can be closed and the cover folded, shown at (14) in FIG. 3. This tightly-folded flap can then be tucked into the jaws of the closer (15) which is secured to the side of the package (11), generally near the lower, unopened end of the package.

Figure 4:
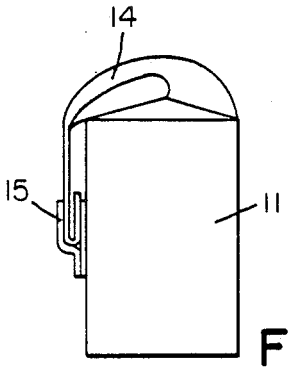
FIG. 4 is a side elevational view similar to FIG. 3 showing the closure of the present invention in operative conjunction with the operative end of the package.

In FIG. 4 there is shown the arrangement where the package flap is tucked into the jaws of the closure (15) and the package tightly re-sealed.

Figure 5:
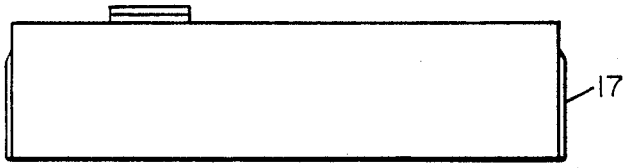
FIG. 5 is a side elevational view of a package of food in a plastic wrap with the closure of the present invention attached thereto.
Figure 6:
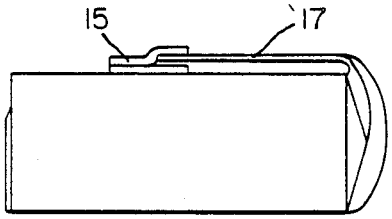
FIG. 6 is a side elevational view similar to that in FIG. 5 with the closure lifted to an operative position.

In FIGS. 5 and 6 there is shown an alternative form of packaging which is often seen in the marketplace as a plastic-wrap block of cheese or the like. This package may be shrink-wrapped or sealed in an air-impermeable film, and when the end (!7) is opened and a portion removed therefrom, the package is generally just folded back upon itself and held in place with a rubber band or the like.

With the present invention, one of the closures (15) can be placed on the side of the package and the flap (17) can be folded back upon itself and held tightly in place by the closure (15) as shown particularly in FIG. 6.

Figure 7:
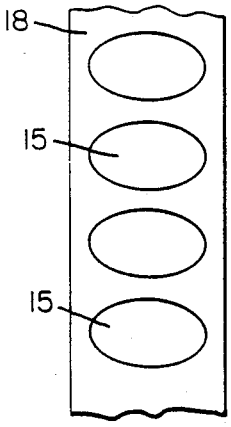
FIG. 7 is a top plan view of a strip of silicone release paper with a plurality of closures of the present invention fastened thereto.
Figure 8:
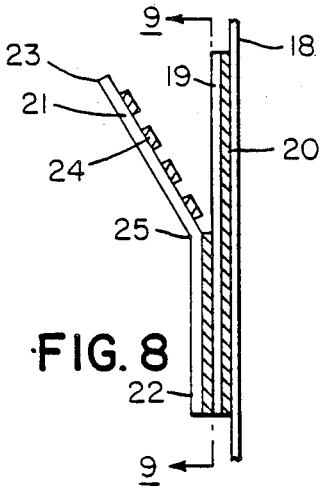
FIG. 8 is an enlarged side elevational view of the closure of the present invention
Figure 9:
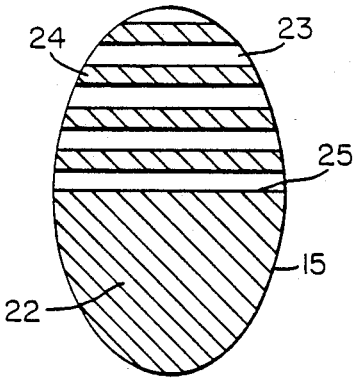
FIG. 9 is a view taken along line 9—9 of FIG. 8.

The closure (15) is shown more particularly in FIGS. 7, 8, and 9, and may, in one preferred embodiment, be an oval-shaped disc about 2" long in its maximum dimension. A plurality of such disc-like closures can be supplied on a strip of silicone release paper (18), in a manner well-known in the art. The closure (15) includes a base portion (19) which may be a thin sheet such as polyethylene polypropylene, paper, metal foil, or the like with an aggressive adhesive (20) on one surface thereof to support the second member 21. Adhesives of this type are well-known in the art, and for this invention may be of the pressure sensitive type, that has the necessary properties that will allow the product to stick (adhere) to the various substrates required. The adhesive (20) will stick to the silicone strip (18) for transportation, sale and use in an applicator device, but when the disc is removed from the silicone strip (18) and applied to the outer surface of the packages (11) or (17), the adhesive firmly and unremovably secures the disc (19) thereto.

The second member (21) of the closure (15) has a shape similar to the disc (19). A lower portion (22) thereof also has an aggressive adhesive on one side thereof, which securely and irremovably holds the lower portion (22) of the disc (21) to the upper surface of the disc (19).

The remainder (23) of the disc (21) has either a less-aggressive adhesive applied thereto, or has an adhesive applied in strips or lines as at (24), and this permits the user to peel back the portion (23) of the disc (21) away from the surface of the disc (19), as is shown in FIG. 8. This opens the "jaws" of the closure.

The type of adhesive or the line-disposition of such adhesive considered herein is illustrated in the Conkrite U.S. Pat. No. 4,299,223.

The strip-type adhesive such as described in the Conkrite patent is advantageous, because a more aggressive adhesive can be used in the areas (24). Because this material is strong in shear but weak in peel, and because only selected areas of the member (21) have adhesive there- on, it is relatively easy to peel back the jaw-portion (21) from the disc (19) up to the fold line or "hinge" line (25) which is the line of demarcation between the areas (22) and (23) on the disc (21).

The advantage of the closure of the present invention is that it can be placed on the "body" of the package, rather than on the freely-moving flap portion. This permits the flap to be folded as much as is necessary to close the package (11) as the contents are progressively removed, and the folded portion of the flap can be tucked within the jaws of the closure to hold the flap tightly in place as shown in FIG. 4.

Moreover, the re-closability or re-sealability of the adhesive mechanism permits this opening, closing, folding and re-sealing to be repeated as often as is necessary to insure that the high quality of the contents is maintained until total consumption thereof.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. The combination of a flexible package comprising a flaccid material capable of being folded and an adhesive closure having a pair of jaws, said package being a soft-sided, bag-like product having a mouth at one end and capable of being refolded to close and re-seal said package;

said adhesive closure disposed on the side of said container with said jaws disposed relative to the folded mouth of the container so that the combination permits a substantial amount of packaged content to be removed and, nevertheless, reseal the container when the closed and re-folded open end of the package is disposed within and held by the jaws of the closure, and wherein said adhesive closure is a pressuresensitive item comprising a first member and a second member, said first member adapted for permanent securement to said container by an aggressive adhesive;

said second member having a fixed portion and a movable portion secured thereto along a hingeline;

said fixed portion permanently secured to a portion of the first member by an aggressive adhesive;

said movable portion having a less aggressive adhesive thereon for removable adhesion, both to the opposed portion of the first member and also to the surface of said container;

the less aggressive adhesive surface of the movable portion of said second member permitting repeated securement to and removal from a portion of the surface of said container; and said movable portion and the opposed portion of said first member creating said pair of jaws to receive a portion of the container therebetween.

2. The combination of claim 1 wherein the less aggressive adhesive surface of the movable portion of said second member is tacky at room temperature.

3. The container of claim 1 wherein said closure is disposed at a sufficient distance from the mouth of said container so as to permit a plurality of opening and reclosing of the container as increasing amounts of the contents of the container are removed therefrom.

4. The combination of claim 1 wherein said less aggressive adhesive is the same material as the said aggressive adhesive, but is placed on the said movable portion in discreet areas so as to enable the removal of the said movable portion from the surface of said container without delaminating the fixed portion of said second member from the opposed area of said first member.

* * * * *